United States Patent [19]

Booth

[11] Patent Number: 4,650,112

[45] Date of Patent: Mar. 17, 1987

[54] LOCKING CARTON BOTTOM

[75] Inventor: Vernard Booth, Albany, Ga.

[73] Assignee: Georgia-Pacific Corporation, Atlanta, Ga.

[21] Appl. No.: 792,605

[22] Filed: Oct. 29, 1985

[51] Int. Cl.[4] ..... B65D 5/10

[52] U.S. Cl. ..... 229/157; 229/156

[58] Field of Search ..... 229/38, 39 R, 156, 157

[56] References Cited

U.S. PATENT DOCUMENTS

| | | | |
|---|---|---|---|
| 1,997,667 | 4/1935 | Woerner, Jr. | 229/39 R |
| 2,339,224 | 1/1944 | Shina | 229/39 R |
| 2,361,603 | 10/1944 | Cohen et al. | 229/39 R |
| 2,990,993 | 7/1961 | Buttery | 229/39 R |
| 4,279,377 | 7/1981 | Peeples et al. | 229/39 R |
| 4,367,840 | 1/1983 | McFadden | 229/39 R |

FOREIGN PATENT DOCUMENTS

| | | | |
|---|---|---|---|
| 218420 | 11/1961 | Austria | 229/39 R |

*Primary Examiner*—William Price
*Assistant Examiner*—Gary E. Elkins
*Attorney, Agent, or Firm*—Banner, Birch, McKie & Beckett

[57] ABSTRACT

A carton for produce and the like has a bottom closure provided by pairs of major flaps and minor flaps hingedly connected to the carton body side walls and end walls, respectively. The major flaps have L-shaped slots cutout adjacent each end of the major flap, each slot providing a pair of generally perpendicular slot legs with one leg terminating adjacent the hinge line connecting the major flap to a side wall of the carton body and the other leg extending longitudinally of the major flap to provide a locking edge generally parallel to such hinge line with the edge terminating at an end abutment. Each minor flap has a fold line segregating an end portion of the minor flap and a cutout segment disposed centrally along the outer end of such end portion, this segment defining spaced locking corners at its opposite ends with projecting tabs on the end portion disposed laterally of the segment ends. With the major flaps folded inwardly to lie in a common plane, the tabs of the end portion of each minor flap are inserted through the L-shaped slots of the major flaps until the locking corners of the cutout segment lockingly engage with the end abutments of the locking edges of the L-shaped slots in the major flaps.

4 Claims, 2 Drawing Figures

LOCKING CARTON BOTTOM

BACKGROUND OF THE INVENTION

This invention relates to the art of cartons or containers commonly constructed of a corrugated paperboard suitable for produce and the like. More particularly, the invention is concerned with a rigidly interlocking bottom closure for a carton.

Corrugated paperboard cartons having a wide variety of constructions are well known in the art. Many of these carton designs employ a plurality of overlapping closure flaps which interlock in various fashions to securely close the top of the carton and a plurality of overlapping bottom closure flaps interlocked to securely close the bottom of the carton. In constructing cartons or containers for fresh fruits and vegetables, it is especially important to provide a strong bottom closure arrangement capable of supporting the considerable weight of the contents.

Frequently the carton manufacturer is located far from where the commodities are to be packed. Thus, as a practical matter, the carton must be capable of being shipped in a flat, collapsed configuration to use shipping and storage space efficiently. Once at the packing location, the flat, collapsed carton must be constructed to be easily fully assembled without requiring skilled personnel or complex equipment. Thus, the action necessary to convert the flat carton from its collapsed condition to its fully assembled state should be performable quickly and simply, preferably without the need to utilize glue, staples or other equipment to secure the carton closure flaps.

For many years, the corrugated paperboard industry has needed a produce box that has a fast locking bottom capable of holding heavy loads such as potatoes, squash, cucumbers, etc. While numerous designs have been tried, these have generally failed in attempting to accommodate heavier loads.

Some bottom closure attempts have adopted the use of a solid blank bottom but this requires a large amount of corrugated paperboard in the manufacture and thus is economically too costly. Another previous approach to enable handing heavy product loads and still have an economical carton was to require the bottom to be glued or stitched. This type carton has not been used as a practical matter because the produce man or farmer did not want to take stitching equipment into the field with him. Also he did not want to have to stitch up the carton bottoms in advance because these "made-up" cartons required to much room for storage and/or transport to the field location where the produce is being harvested.

SUMMARY OF THE INVENTION

A principal object of the present invention is to provide a rigid interlocking bottom closure for a corrugated paperboard carton which may be quickly and easily assembled from a flat carton blank so as to possess sufficient strength to carry heavy objects such as produce loaded into the carton.

A further primary object of the present invention is to provide a carton in accordance with the above object which possesses a strong highly rigid bottom closure without having the need for tape, glue or other fasteners to close the carton bottom.

A further object of the present invention is to provide a carton with an interlocking bottom closure which is collapsible so that the cartons may be shipped in a flat, collapsed configuration.

The above and other objects of the invention are accomplished by employing a unitary carton blank having a series of wall panels forming a pair of side walls and a pair of end walls, these panels being hingedly coupled in series along parallel fold lines with an appropriate fastening flap at the end of the series of panels to connect the panels into a tubular carton body. Each of the panels forming a side wall has a major closure flap hingedly connected along an edge of this panel and each of the panels forming an end wall has a minor closure flap hingedly connected along an edge thereof.

A slot is formed adjacent each end of each of the major flaps, this slot terminating adjacent the hinge line connecting the major flap to a side wall of the carton body. This slot provides a locking edge remote from and generally parallel to the hinge line with this edge terminating at an end abutment. Each minor flap has a fold line segregating an end portion of the minor flap and a cutout segment disposed centrally along the outer end of this end portion. The cutout segment defines spaced locking corners at its opposite ends with outwardly projecting tabs disposed laterally of these segment ends.

With the major flaps folded inwardly to lie in a common plane, the tabs of the end portion of each minor flap are inserted through the slots of the major flaps until the locking corners of the cutout segment lockingly engage with the locking edges and end abutments of the slots in the major flaps.

Preferrably the sots formed in the major flaps are L-shaped so as to provide a pair of generally perpendicular slot legs with one leg terminating adjacent the hinge line connecting the major flap to the side wall of the carton body and the other leg extending longitudinally of the major flap to provide the locking edge which extends generally parallel to the hinge line with this edge terminating at the end abutment. In utilizing these L-shaped slots, the shape of the minor flaps and positioning of the slots in the major flaps ideally results in the locking corners of the cutout segment being engaged with the end abutments of the locking edges of the slots.

It also is desirable to have the locking corners which engage with the end abutments reach this interlocking relationship at least one-third of the length of the major flap from the end of the major flap. Where this locking relationship occurs even closer toward the center of the length of the major flaps, the locking achieved is improved and the bottom closure becomes even stronger.

The above and other objects of this invention will become more apparent by reference to the detailed description given hereinbelow. The novel features of this invention are particularly recited in the appended claims, but the invention will be understood more fully and clearly from the following detailed description of the invention given with reference to the accompanying drawings.

DESCRIPTION OF A PREFERRED EMBODIMENT

Figure 1:
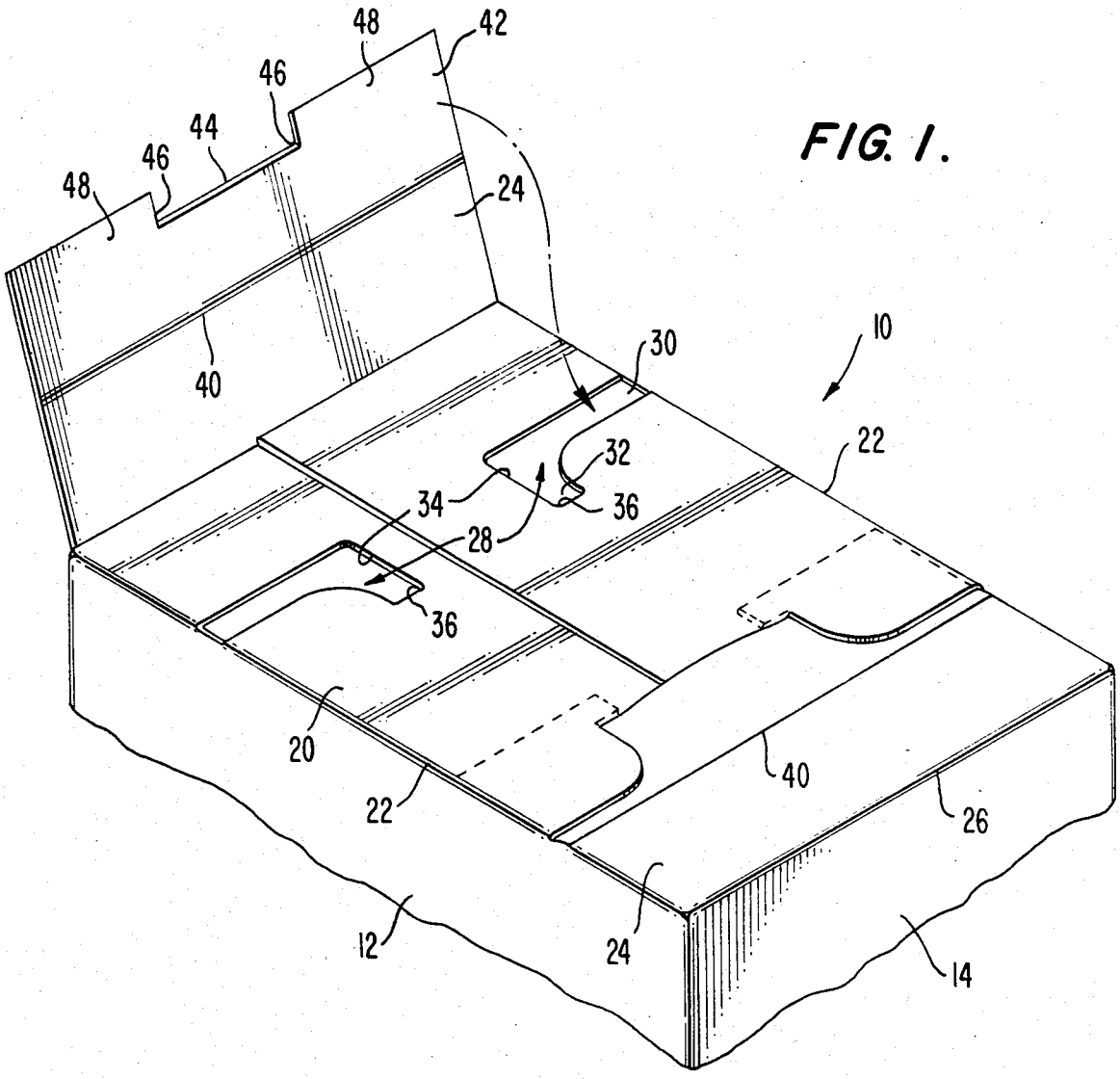
FIG. 1 is a perspective view of the partially assembled carton bottom closure of this invention, one of the minor flaps being shown interlocked with the pair of major flaps.
Figure 2:
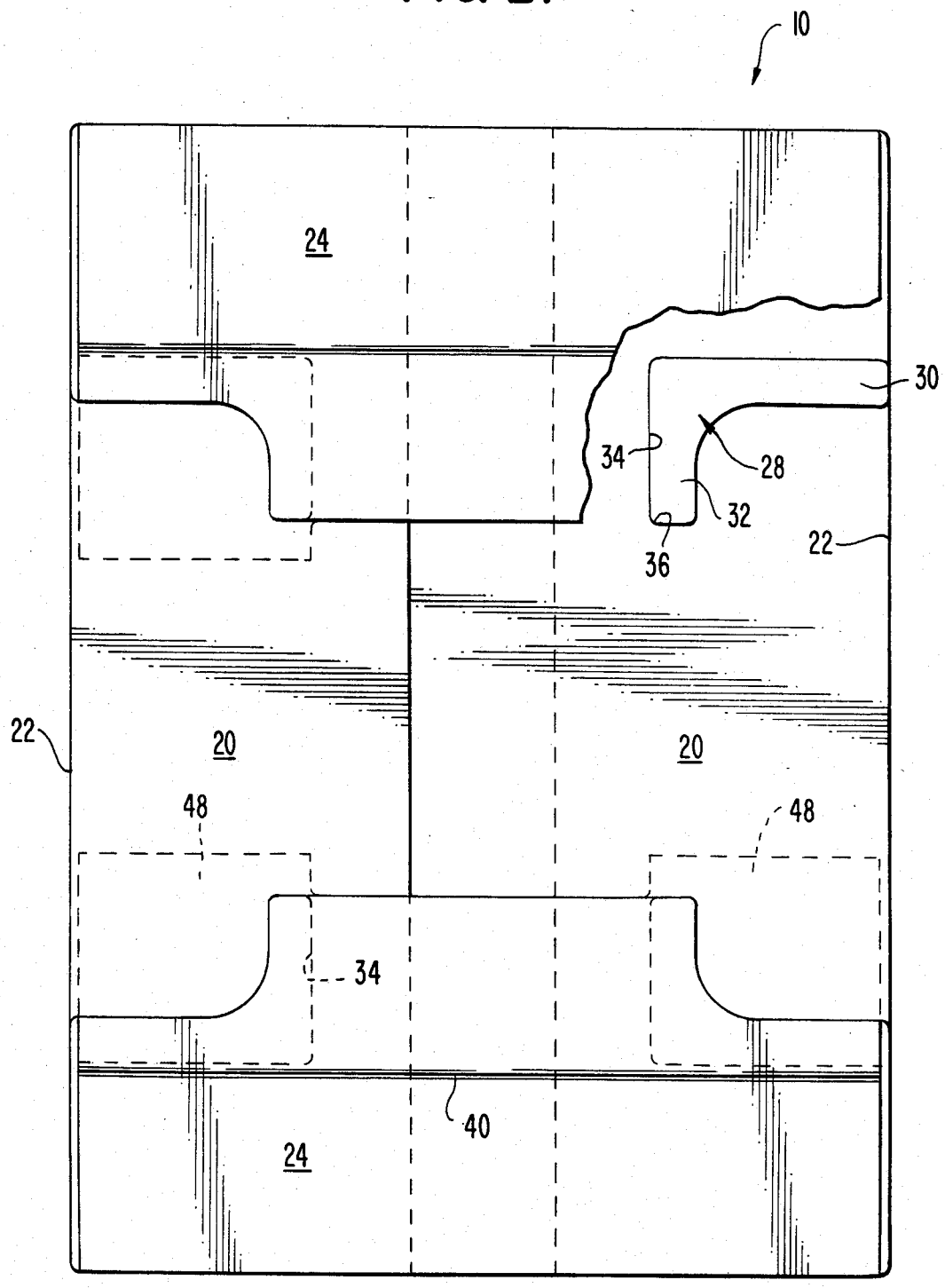
FIG. 2 is a bottom plan view of the assembled carton of FIG. 1 with a portion of a minor flap broken away.

Both FIGS. 1 and 2 on the drawings display the bottom closure of a carton 10 which is rectangular in shape. Certainly it will be recognized that the relative dimensions of the pair of opposed side walls and pair of opposed end walls forming the carton are not important to the bottom closure which utilizes closure flaps that are hingedly connected along edges of the side walls and end walls.

It also will be recognized that the rectangular carton 10 such as shown on the drawings is to be formed from a single, generally rectangular unitary panel blank. This blank is suitably cut, scored, perforated, etc. to be folded into the completed carton 10 of FIGS. 1 and 2.

As may be best understood from FIG. 1, carton 10 has a generally tubular carton body providing a pair of opposed sidewalls 12 and a pair of opposed end walls 14, only one of each of the side and end walls 12 and 14 being visible in the perspective view of FIG. 1. As well known in the manufacture of paperboard cartons, this tubular carton body is formed from a series of wall panels which provide the pair of side walls and a pair of end walls. The panels are hingedly coupled together in a series along parallel fold lines. A fastening flap (not shown) at the end of the series of panels serves to connect the panels into the tubular carton body. The fastening flap may be suitably glued, stapled or otherwise secured to form this series of panels into the tubular carton body, all as known and conventional in the prior art.

In the formation of the carton blank which is folded into carton 10, each of the wall panels forming a side wall 12 has a major closure flap 20 hingedly connected along an edge thereof at hinge line 22. Likewise, each of the wall panels forming an end wall 14 has a minor closure flap 24 hingedly connected along an edge thereof at hinge line 26. Collectively, when the two major flaps 20 and two minor flaps 24 are folded to lie perpendicular to the side and end walls 12 and 14 of the carton 10, these flaps form the bottom closure for carton 10.

A slot 28 is formed adjacent each end of each of the major flaps 20. This slot is L-shaped so as to provide a pair of generally perpendicular slot legs 30 and 32. Leg 30 extends transversely relative to the width of major flap 20, terminating adjacent the hinge line 22 which connects the major flap 20 to the side wall 12 of the carton body. The other slot leg 32 extends longitudinally of the major flap 20 and provides a locking edge 34 extending generally parallel to the hinge line 22 with edge 34 terminating in an end abutment 36.

Each of the minor flaps 24 is scored to form a fold line 40 extending the full length of the minor flap 24. Fold line 40 segregates an end portion 42 of the minor flap 24. Providing fold lines 40 enables the minor flaps 24 to be readily and accurately folded to facilitate assembly of the carton in the manner as will be explained hereinafter.

The end portion 42 of each minor flap 24 has a cutout segment 44 formed centrally along the outer end of portion 42 of minor flap 24. The opposite ends of segment 44 define spaced locking corners 46. With the centrally formed cutout segment 44 in the end portion 42 of minor flap 24 there are created a pair of projecting tabs 48 on minor flap 24, these tabs being disposed laterally of the ends of segment 44 where the locking corners 46 are provided.

As may be best seen from FIG. 2, the combined width of the major flaps 20 is such that these flaps substantially overlap one another when folded generally perpendicular to the side walls 12 of carton 10. This overlapping relationship between the major flaps 20 hingedly connected to the opposite side walls 12 of carton 10 offers an added degree of strengthening to the overall rigidity of the bottom closure on carton 10. However, it is to be recognized that the pair of major flaps 20 may have a combined width such that their edges only meet when they are folded inwardly to lie in a common plane in forming the bottom closure of carton 10.

Having described the structure of the components making up the carton 10, description may now be given as to the manner in which the components are assembled in forming the rigid bottom closure for carton 10.

Initially, the two major flaps 20 are folded inwardly to overlap and essentially lie in a common plane. In the embodiment illustrated on the drawings, the major flaps 20 overlap for a substantial distance as may be seen on FIG. 2, this overlapping relation contributing to the rigidity and strength of the bottom closure on carton 10.

With the major flaps 20 positioned as described above, the two minor flaps 24 are folded inwardly over major flaps 20. To facilitate introducing the tabs 48 into the L-shaped slots 28 in the major flaps 20, the end portion 42 of each minor flap 24 is folded along the scored fold line 40. In this partially folded condition the tabs 48 may be easily introduced into the slot legs 30 of slots 28. Then the partially folded end portion 42 of each flap 24 can be easily pressed down for the minor flaps 24 to assume a flat condition lying along the bottom of the carton 10 leaving the major flaps 20 exposed on the interior of carton 10.

The sizing of minor flaps 24 and cutout segment 44 relative to the location of the L-shaped slots 28 is such that preferably the locking corners 46 of cutout segment 44 after sliding along the locking edges 34 of slots 28 come into engagement with the end abutments 36 of slots 28.

With the locking corners 46 engaged with the end abutments 36, the span of corrugated paperboard defined by the length of the edge of cutout segment 44 provides a rigidifying effect to essentially prevent the major flaps 20 and the walls 12 to which they are hingedly connected from spreading apart. It should be noted that in studying the action of a carton which is being filled with heavy produce, characteristically the downward force applied by the produce being loaded tends to push out the bottom sides of the carton. Overlapped bottom major flaps in a carton automatically causes the flaps to push apart. The locking action of the bottom closure acts to stop this outward pushing action.

The cutout segment 44 in the end portion 42 of minor flaps 24 forms a U locking principle, leaving one continuous span of corrugated paperboard passing from one side to the other side with the U locking principle where it engages the locking edges 34 and end abutments 36 of slots 28 holding the major flaps 20 and walls 12 to which they are connected from spreading apart. This U locking effect is created by the length of cutout segment 44 between locking corners 36 being essentially equal to the distance between the locking edges 34 of slots 28 when major flaps 20 are folded in as shown on FIG. 1.

The "U" locking principle preferably is provided sufficiently far along the bottom length of the carton to be fully effective. The more the U locking arrangement is moved toward the center of the length, the stronger this U lock becomes.

Allowing the minor flaps 24 to fold in following the major flaps helps to hold the major flaps 20 up in their proper flat position. Preferably the minor flaps 24 need to be long enough to reach one-thrd or a greater portion of the carton length dimension. This places the interengaging end abutments 36 and locking corners 46 at locations at least one third of carton length from each end of the carton.

These minor flaps 24 must be scored at 40 to allow the end portion 42 to be folded and inserted into the L-shaped slots 28 on the major flaps 20. This locking action marries the two major flaps 20 together to form a U-shaped lock across the width of the box. It also draws the minor flap 24 up flush with the bottom of the box as the partially folded minor flaps 24 are pushed into flat closed position relative to the major flaps 20.

It will be appreciated from the above disclosure of the invention, including illustration and description of a preferred embodiment of such invention, that the carton 10 may be easily folded from a single, generally rectangular blank into a strong carton having a rigid self-locking bottom closure. While the carton 10 might find particular applicability in being loaded, stored and transporting produce, it will be recognized that the carton is subject to utilization in a multitude of environments other than with produce.

Also, it is to be understood that the embodiment of the invention herein shown and described must be taken as a preferred representation of the invention. Thus, it will be obvious to one of ordinary skill in the art that numerous modifications and changes may be made without departing from the true spirit and scope of the invention which is to be limited only by the appended claims.

I claim:

1. A carton for produce and the like with a locking bottom closure comprising:

a tubular carton body providing a pair of opposed side walls and a pair of opposed end walls, said pairs of walls being generally normal to each other;

each of said side walls having a generally rectangular major closure flap hingedly connected thereto defining a hinge line therebetween;

each of said end walls having a generally rectangular minor closure flap hingedly connected thereto;

a generally, rectangular cutout segment formed centrally along the outer end portion of each of said minor flaps, said segment defining spaced locking corners at the opposite ends of said segment with projecting tabs on the end portion of the minor flap disposed laterally of said ends of said segment, respectively;

a slot formed adjacent each end of each of said major flaps, said slot terminating adjacent said hinge line connecting the major flap to a side wall of said carton body and providing a locking edge remote from said hinge line with said edge terminating at an end abutment, said slots being L-shaped providing a pair of generally perpendicular slot legs with one leg terminating adjacent said hinge line connecting the major flap to the side wall of said carton body and the other leg extending longitudinally of said major flap to dispose said locking edge extending generally parallel to said hinge line with said edge terminating at said end abutment, said locking corners being engaged with said end abutments, respectively;

a single transverse fold line extending the full length of each of said minor flaps to divide each of said minor flaps into outer and inner sections with each inner section being hingedly connected to one of said end walls and said tabs carried by said outer section;

said closure flaps being folded generally perpendicular to said side and end walls of said carton body respectively, to form a carton end closure with said minor flaps each being folded along said fold line to have said tabs on said outer section inserted through said slots of said major flaps and said locking corners of said segment being lockingly engaged with said locking edges of said slots in said major flaps.

2. A carton as recited in claim 1 wherein said major flaps are of a combined width such that the major flaps overlap one another when folded generally perpendicular to said walls of said carton.

3. A carton as recited in claim 1 wherein said end abutment of each of said L-shaped slots is disposed at least one-third of the length of the major flap from the end of the major flap.

4. A carton as recited in any one of claims 1 or 2 wherein said minor flaps are disposed beneath said major flaps in the bottom closure of said carton with said major flaps being exposed on the interior of said carton.

* * * * *